United States Patent [19]

Day

[11] Patent Number: 4,534,374

[45] Date of Patent: Aug. 13, 1985

[54] FULLY AUTOMATIC SINGLE PUSH BUTTON TYPE UMBRELLA

[76] Inventor: San-Tong Day, 1 Chung Yang North Rd., Ching Shui, Taiwan Hsien, Taiwan

[21] Appl. No.: 577,826

[22] Filed: Feb. 7, 1984

[51] Int. Cl.[3] ..... A45B 25/16

[52] U.S. Cl. ..... 135/22; 135/24

[58] Field of Search ..... 135/22, 24, 23, 20, 135/21, 26

[56] References Cited

U.S. PATENT DOCUMENTS

| | | | |
|---|---|---|---|
| 3,003,508 | 10/1961 | Bremshey | 135/24 |
| 3,658,077 | 4/1972 | Sato | 135/24 |
| 3,672,382 | 6/1972 | Sato | 135/24 |
| 3,756,258 | 9/1973 | Yoshihara | 135/24 |
| 3,856,030 | 12/1974 | Sato | 135/24 |
| 4,421,133 | 12/1983 | Huang | 135/24 |

*Primary Examiner*—Richard J. Johnson

*Attorney, Agent, or Firm*—Burns, Doane, Swecker and Mathis

[57] ABSTRACT

An umbrella automatically openable and closable by a single push-button operation. The umbrella comprises an outer tubular shaft having a lower ring fixed on the upper end thereof; an intermediate tubular shaft slidably inserted in the outer tubular shaft and having an intermediate ring on the upper end thereof; an upper inner shaft slidably inserted in the upper end of the intermediate tubular shaft and having an upper ring fixed on the upper end thereof; a lower inner shaft slidably inserted in the lower end of the intermediate tubular shaft and having on the lower end thereof a grip, operably mounted thereinside a first spring pawl attached with a push button on the lower end thereof and a second spring pawl; a first spring means fitted over the intermediate tubular shaft in between the intermediate ring and the lower ring; and a second spring means mounted inside the intermediate tubular shaft in between the upper inner shaft and the lower inner shaft.

4 Claims, 8 Drawing Figures

FULLY AUTOMATIC SINGLE PUSH BUTTON TYPE UMBRELLA

DETAILED DESCRIPTION

The present invention relates to automatically openable and closable umbrella, more particularly, to an umbrella which can be opened and closed automatically by operating a single push button.

Several types of automatic umbrella which can be opened and closed automatically have been disclosed in the past, to take for example, U.S. Pat. No. 3,856,030 to Sato. In the prior art, the umbrella employs, however, two push button means for operation of opening and closing respectively. Such an umbrella is not only complicated in construction, but also difficult and troublesome in assembling, and hence ends in its high cost. Besides, since the operating mechanism occupies more spaces, consequently, the space for operating such a mechanism has to be enlarged, this will inevitably affect the aesthetic design of the umbrella. Furthermore, since there is no safety device in the push button means, if a wrong push button means is operated, the umbrella which has been opened may be mistakenly closed or it may result in malfunction of the means.

It is, therefore, an object of the present invention to obviate shortcomings of the conventional automatic umbrella previously discussed, and to provide a fully automatic umbrella that can be opened and closed by operation of a single push button.

Another object of the invention is to provide a single-push-button-controllable, automatic umbrella wherein the push button means is a double-lock mechanism which prevents the umbrella from opening to closing wrongly or from causing malfunction of the members when a person presses a wrong means accidentally.

A further object is to provide a single-push-button-controllable, automatic umbrella wherein the push button means for operation is slender and simple, and which enables the operational portion of the umbrella to be aesthetically designed.

An additional object is to provide such an umbrella which is simple in construction, easy to manufacture and whose cost of production is low.

Other aspects and advantages of the present invention will become apparent from the following description of the preferred embodiment, taken in conjunction with the accompanying drawings in which.

Figure 1:
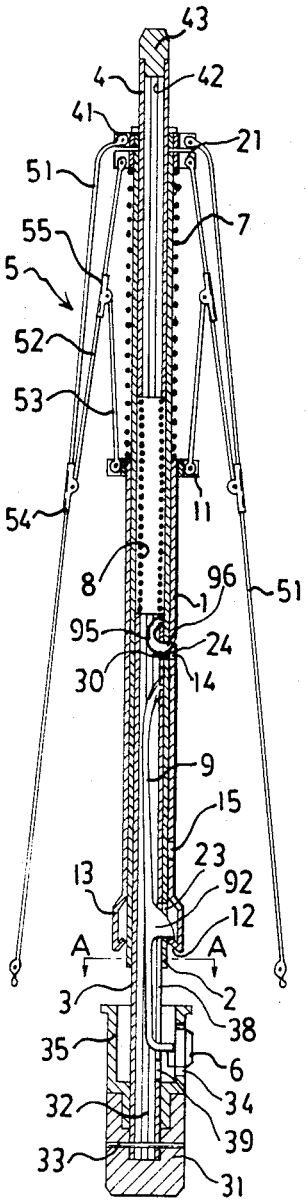
FIG. 1 illustrates an umbrella of the invention in partly sectional elevation in the closed and folded state.

Referring initially to FIG. 1, an automatic umbrella of the invention comprises an outer tubular shaft 1, an intermediate tubular shaft 2, a lower inner shaft 3, an upper inner shaft 4, a plurality of ribs 5, an operational push button 6, a first coil spring 7 and a second coil spring 8. The outer shaft 1 has at the upper end a lower ring 11 fixed thereto and the intermediate shaft 2 is slidably inserted in the outer shaft 1 and is provided at the upper end with an intermediate ring 21 fixed thereto. Of the two inner shafts, the lower shaft 3 is slidably inserted in the lower end of said outer shaft 2 and has at the lower end a grip 31, whereas the upper shaft 4 is slidably inserted in the upper end of the intermediate shaft 2 and is provided at the upper end portion with an upper ring 41 fixed thereto. Said rings 11, 21 and 41 are carrying pivotably each one end of ribs 5, and surrounding the upper portion of the intermediate shaft 2 and between the intermediate ring 21 and lower ring 11 there is mounted the first coil spring 7. The push button 6 is operably disposed between the lower inner shaft 3 and the upper portion of the grip 31, and encased in the intermediate shaft 2 and between the upper inner shaft 4 and lower inner shaft 3 there is mounted the second coil spring 8.

Figure 4A:
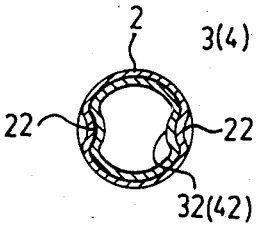
FIG. 4(A) is a sectional view of the portion of the umbrella taken along the line A—A in FIG. 1.
Figure 4B:
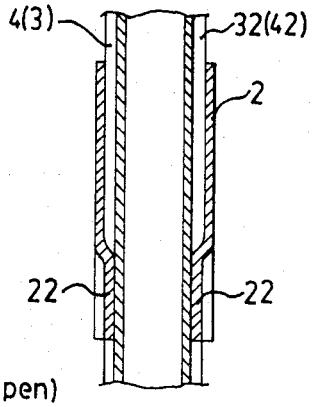
FIG. 4(B) is a longitudinal sectional view of portion of the members as shown in FIG. 4(A)
Figure 5:
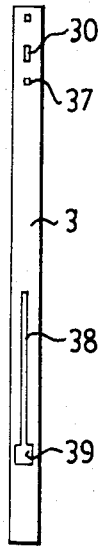
FIG. 5 illustrates a portion of the lower inner shaft member wherein axial slot and openings are shown.

While the upper end of the abovementioned outer tubular shaft 1 is provided with the lower ring 11, the lower end is formed into an enlarged tubular portion 13 having an inwardly extending annular flange 12. In addition, two openings 15, 14 are formed at the lower end portion and the middle portion on one side of the outer shaft 1 respectively for engaging with the second spring pawl 95 which will be described hereinafter. The intermediate shaft 2 being slidably inserted in the outer shaft 1 is longer than the latter and having at the upper end an intermediate ring 21 fixedly mounted thereto; the inner sides of the upper and lower end portions thereof are further formed with at least one, preferably two according to the present embodiment, symmetrically and inwardly guide convex portions 22, 22 as shown in FIGS. 4(A) and 4(B). When in operation, said two convex portions 22, 22 prevent the upper and lower inner shafts 4, 3 from rotating inside the intermediate shaft 2, and also act as guide-projection when the two inner shafts 3, 4 are sliding up and down therein. In addition, two opening 23, and 24 are defined on one side in the wall of the intermediate shaft 2 at the lower end portion and the middle portion therof respectively. The former is located between the two convex portions 22, 22 to allow the enlarged locking head 92 of the first spring pawl 9 (which will be described hereinafter) to be engaged therein, and the latter is located above the first spring pawl 9 to allow a second spring pawl 95 to be engaged therein. Both the lower inner shaft 3 and upper inner shaft 4 are defined with at least one, but preferably two symmetrically arranged guide-grooves 32, 42 as illustrated in FIGS. 4(A) and 4(B). While the upper portion of the lower inner shaft 3 is slidably inserted in the lower portion of the intermediate shaft 2, the lowerportion of the upper inner shaft 4 is slidably inserted in the upper portion thereof, and further, the convex portions 22, 22 formed at the upper and lower end portions of the intermediate shaft 2 are engaged in the guide-grooves 42, 32 of the lower and upper inner shafts 3, 4 to impede rotation thereof in the intermediate shaft 2. The grip 31 is fixedly mounted to the lower end portion of the lower inner shaft 3 by a locking pin 33 provided therewith, and above the upper end portion of said grip 33 there is mounted an sleeve member 35 having at one side an oblong opening 34 and receiving the push button 6 operably disposed therein.

Located inside the lower inner shaft 3 and extending almost the whole length thereof is the first spring pawl 9 whose fixed end 91 is fixed in a recess 37 defined in the upper portion of the lower inner shaft 3 and in the middle portion of the spring pawl 9 there is formed an enlarged locking head 92 protruding from the front end portion of an elongated slot 38 formed in the lower inner shaft 3 while the other end thereof is formed with a F-shaped projection 93 being more extended than the locking head 92 and having a notch 94 thereof. The projection 93 is protruding behind the elongated slot 38 into the push button 6 which is slidably mounted therto. The push button 6 is in turn protruding from the opening 34 of the sleeve member 35, and has at the below front portion thereof a hole 61 adapted to be slidably engaged with the projection 93, while at the hinder end thereof a hook portion 62 is extending below and forward and adapted to be engaged with the notch 94 in the hinder side of the projection 93. Between the inner front wall of the hole 61 and the projection 93 there is mounted a spring 63 adapted to urge the push button 6 always in the forward position so that the hook portion 62 is engaged with the notch 94. Behind the aforementioned slot 38 there is formed continuously therewith an enlarged rectangular opening 39 which coincides with the opening 34 of the sleeve member 35. Above the first spring pawl 9 there is provided with the second spring pawl 95 at the upper end of the inner shaft 3, the locking head 96 of which is protruding from the opening 30 into the opening 24 of the intermediate shaft 2. An upper ring 41 is fixedly mounted to the slightly mid portion of the upper inner shaft 4, the upper tip of which is screwed with a cap 43.

A plurality of ribs includes usually 8 to 10 dome ribs, a same number of stretcher ribs 52 and a same number of supporting ribs 53. One end of each dome rib 51 is pivotably mounted at the upper ring 41 while the other end remains free and the middle portion thereof, on the other hand, is mounted with a pivot member 54 adapted to connect pivotably with one end of the stretcher rib 52, the other end of which is, again pivotably mounted at the intermediate ring 21. The middle portion of the stretcher rib 52 is also mounted with a pivot member 55 adapted to connect pivotably with one end of the supporting rib 53 while the other end thereof is pivotably mounted at the lower ring 11. The coil spring 7 provided in between the intermediate ring 21 and lower ring 11, is in freely extended condition when the umbrella has been closed as shown in FIG. 1; on the other hand, the coil spring 8 is in the compressed condition when the umbrella has been closed, and tends to urge the upper inner shaft 4 and lower inner shaft 3 upward and downward respectively. However, since the intermediate shaft 2 and outer shaft 1 are all locked by way of the locking heads 92 and 96 of the two spring pawls 9 and 95 at this time, the coil springs 7, 8 are unable to pull apart the intermediate shaft 2 and the outer shaft 1, and the upper inner shaft 4 and the lower inner shaft 3.

Figure 7:
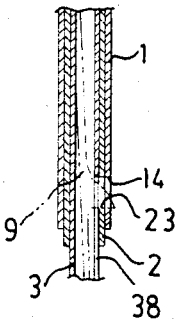
FIG. 7 is a sectional view of the components of another embodiment showing the engaging means of the outer shaft member.

In one embodiment, an opening 16 which coincides with the opening 23 of the intermediate shaft 2 may be defined in the lower end portion of the outer shaft 1 in place of the aforementioned annular flange 12 as shown in FIG. 7.

In operation, when the automatic umbrella of the invention is in fully closed position as shown in FIG. 1, the ribs are completely turned down: the coil spring 7 is fully extended and released while the coil spring 8 is being compressed, thereby elastic energy is accumulated. At the same time, the outer tubular shaft 1, the intermediate tubular shaft 2 and the lower inner shaft 3 are all being locked by the two spring pawls 9 and 96 so as to keep the umbrella in the closed condition. Furthermore, the push button 6 being positioned in the upper part of the opening 34 has the hook portion 62 thereof engaging in the notch 94 of the projection 93.

Figure 2:
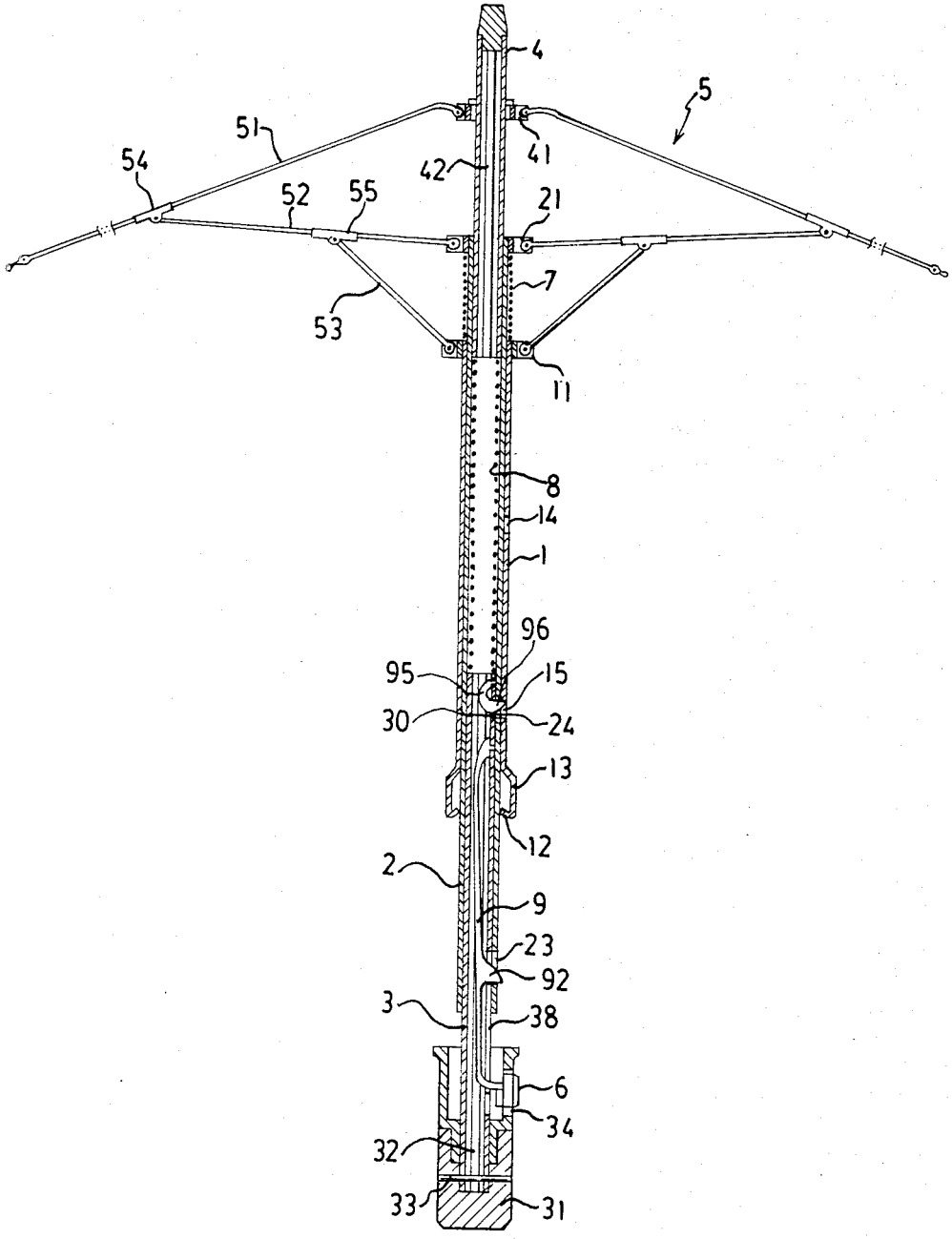
FIG. 2 shows an umbrella of the invention in partly sectional elevation in the fully extended position.

In the process of opening of the umbrella from its closed position, the push button 6 is depressed and with the fixed end 91 as a supporing point in against the resilient force of the spring pawl 9 the projection 93 is being pulled down thereby till the locking head 92 is disengaged from the outer shaft 1 and retracts into the opening 23 of the intermediate shaft 2. Because the push button 6 has been so mounted, that when it is in a forward position, it can be depressed down to a length only whereby the locking head 92 was just released from engagement in the flange 12 of the first outer shaft 1, i.e., a slight distance of d, but is still engaged in the opening 23 of the intermediate shaft 2. Hence, the intermediate shaft 2 and the lower inner shaft 3 are still maintained in an engaging manner. The released outer shaft 1 being biased by the upward extension force of the coil spring 8 forces the second spring pawl 95 to disengage from the opening 14, and the upper inner shaft 4 to move upward with respect to the intermediate shaft 2, and consequently, the upper ring 41 is also moved upward along with the upper inner shaft 4. Although the ribs 51 which are pivotably mounted to the ring 41 tend to move upward along with the latter, however, since the mid portion of the rib 51 is pivotably connected with one end of the stretcher rib 52, the other end of which being pivotably mounted to the intermediate ring 21 and further, the intermediate ring 21 being held fixed with respect to the intermediate shaft 2, the dome ribs 51 are, therefore, turned up gradually as the upper ring 41 is being extended upward and the stretcher rib 52 with the pivot point of the intermediate ring 21 as center is moving upward. Along with the upward movement of the stretcher ribs 52, the supporting ribs 53 pivotably connected thereto in against the spring force of coil spring 7 pulls up the outer shaft 1 with respect to the intermediate shaft 2. The coil spring 7 in between the intermediate ring 21 and lower ring 11 is therefore compressed by the upward extension of the outer shaft 1 and an elastic energy is accumulated thereby for use in closing the umbrella next till the second spring pawl 95 engages in the lower opening 15 of the outer shaft 1. When the coil spring 7 is fully compressed and both forces of the springs 7, 8 are in equilibrium state, the upper inner shaft 4 and the outer shaft 1 extend no more and the coil spring 8, still retaining some extension force, is in a partially extended condition. The umbrella is opened now in a fully extended state ready for use as shown in FIG. 2.

Figure 3:
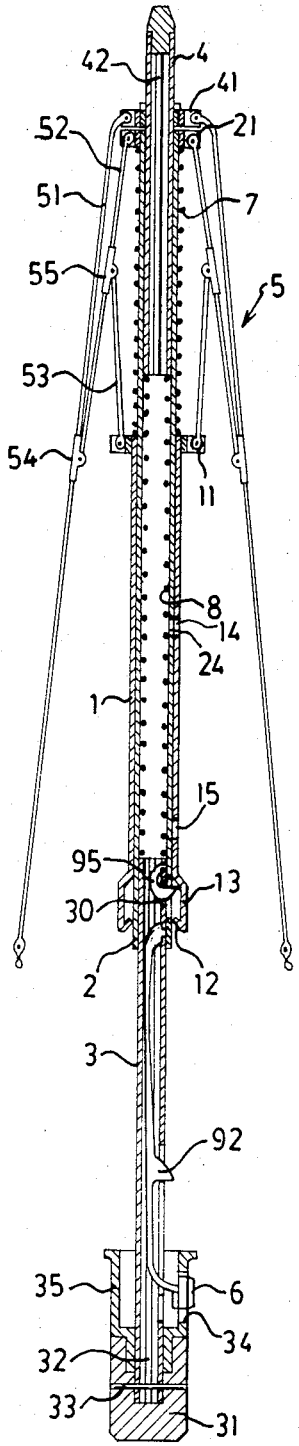
FIG. 3 depicts an umbrella of the invention in partly sectional elevation in the closing state from the position as shown in FIG. 2.
Figure 6:
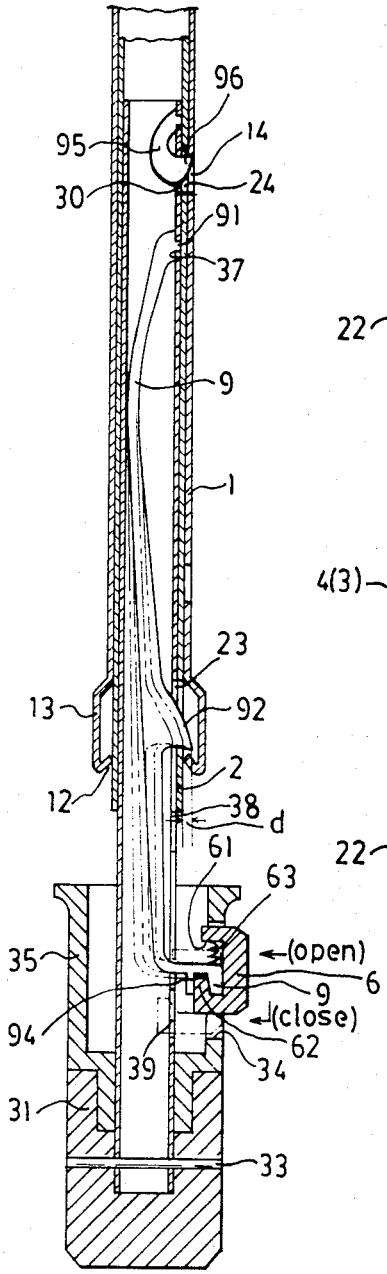
FIG. 6 is an enlarged sectional view of a detail of operation of the push button mechanism shown in FIG. 1.

When an umbrella which has been opened is next to be closed, the push button, as illustrated in FIG. 6, is depressed downward in against the spring force of the coil spring 63 and then toward the enlarged opening 39. The push button 6, in opposing the elastic force of the spring pawl 9 and being in exactly above said opening 39 now, is moved into the undermost position whereby the locking head 92 is disengaged from the opening 23 of the intermediate shaft 2. Although the partial extension force of the coil spring 8 tends to urge the lower inner shaft 3 to move downward, in other words, to push said shaft 3 outward, nevertheless, since the grip is held firmly by a person and the lower inner shaft 3 is stationary, the extension force of the second coil spring 8 acts instead on the upper inner shaft 4 which is made to slide upward and to bring the ribs 51 to close thereby. Meanwhile, as the intermediate shaft 2 is in a freely slidable state, the extension force of the first coil spring 7 acts via the intermediate ring 21 to urge the intermediate shaft 2 to move upward and the outer shaft 1 downward. When the intermediate shaft 2 moves upward, the second spring pawl 95 is forced to retract into the opening 30 and to be disengaged from the hole 24 and 14 by the lower side wall of the hole 24 cooperating with the slop of the locking head, thus the outer tube then slides downward relative to the intermediate shaft 2. The movement of the two shaft 1, 2 cause the ribs to be turned down to the closing position through the linked movement of stretcher ribs and supporting ribs 52, 53 along with the rings 11, 21 and 41, respectively, until both coil springs 7 and 8 are in their extended and substantially unstressed condition, and the umbrella is closed as shown in FIG. 3. As a next and final step of the series of operations, the shaft is contracted by holding the umbrella down against the ground or any hard surface and applying compression force at the opposite ends of the shaft, i.e., at the tip of the upper inner shaft 4 and the grip 31, in opposing the extension force of the coil spring 8. As the compression force is applied, the lower inner shaft 3 is inserted deeply into the intermediate shaft 2 by compressing the coil spring 8 until the locking head 92 of the first spring pawl 9 in the lower inner shaft 3 engages into the opening 23 of the intermediate shaft 2 and protrudes into the enlarged tubular portion 13 of the outer shaft 1 thereby locking against the engaging means 12 and making the intermediate shaft 2 and the outer shaft 1 a single shaft together with the upper inner shaft 3. On the other hand, the compression force of the first coil spring 7 has now weakened and is in a free state whereas the second coil spring 8 is in a compressed position and the energy is accumulated thereby to be consumed for automatically closing umbrella after it has been opened.

In the embodiment described above and shown in FIGS. 1 through 7, not only is the operation of opening and closing of the umbrella that can be performed with a single push button, but also the misfunction or malfunction of the mechanism can be avoided due to the function of the double-lock construction. In achieving the closing of the umbrella when it is in an opened state, the push button 6 must be depressed downward in against the extension force of the spring 63 and then toward the inner side of the sleeve member 35 so that the intermediate shaft 2 is disengaged from the upper inner shaft 3; nothing will happen if the push button is merely pressed or pulled down. Hence, the umbrella which has been opened will not close if the push button is accidentally pressed on. Furthermore, unlike the conventional automatic umbrella wherein different push buttons have to be operated separately, the umbrella of the invention is very convenient to use. Still further, the umbrella according to the invention is simple in construction and the push button portion can be esthetically designed accordingly.

Although the invention has been described in detail with reference to its presently preferred embodiment, it will be understood by one of ordinary skill in the art that various modifications can be made without departing from the spirit and scope of the invention.

I claim:

1. A fully automatic single push button type umbrella comprising:

an outer tubular shaft provided with a lower ring fixed to an upper end and pawl engaging openings at a lower end and said upper end thereof;

an intermediate tubular shaft slidably disposed within said outer tubular shaft and provided with an intermediate ring fixed to an upper end pawl engaging openings at a lower end intermediate the ends thereof;

a lower inner shaft slidably inserted in a lower end portion of said intermediate tubular shaft and provided with a grip mounted to a lower end thereof;

an upper inner shaft slidably inserted in the upper end of said intermediate tubular shaft and provided with an upper ring fixed to an upper end thereof;

a plurality of ribs including dome ribs, stretcher ribs and supporting ribs pivotably interconnected to said rings to form an umbrella frame;

first spring means for closing the umbrella provided on said intermediate tubular shaft between said intermediate and lower rings and a second spring means for opening said umbrella provided within said intermediate tubular shaft between said upper and lower inner shafts;

said lower inner shaft provided with an axially elongated slot at the lower end thereof with said slot having an enlarged lower portion and further provided with an upper opening at an upper end;

said lower inner shaft being further provided with a first and second spring pawl means for locking said intermediate tubular shaft and said outer tubular shaft;

said first spring pawl means having an upper end fixedly attached to the upper end wall of said lower inner shaft, a lower end being free from attachment and provided with a projection protrusible through the lower end of said elongated slot, and an intermediate portion provided with a locking head protrusible through an upper portion of said elongated slot;

a push button member engageable with said projection;

wherein, when the umbrella is in the closed position, said locking head of the first spring pawl means is engaged in the opening of the lower end of said intermediate tubular shaft and the pawl engaging means on the lower end of said outer tubular shaft;

said second spring pawl means is engaged in the upper opening of the intermediate tubular shaft and the upper opening of the outer tubular shaft;

and wherein, when the umbrella is in the open position, said locking head is engaged only in the lower opening of said intermediate tubular shaft and the second spring pawl means is engaged in the upper opening of said intermediate tubular shaft and the lower opening of said outer tubular shaft.

2. A fully automatic single push button type umbrella according to claim 1, wherein a sleeve member is provided on an upper end of said grip and provided with a push button opening on a side thereof which coincides in position with said enlarged opening of the elongated slot; said push button being mounted in the push button opening of said sleeve member and slidably mounted on the projection of said first spring pawl member; said projection provided with a slot on a lower side, said push button provided with a hook portion for engagement with said slot and a spring means provided in a cavity of said push button between a front wall of said cavity and a front end projection, whereby said push button is always biased towards the front side and said hook portion thereof is made to engage in said notch.

3. A fully automatic single push button type umbrella according to claim 1, wherein said push button is arranged such that there is an operating distance provided thereunder, whereby said push button can be pushed deep enough only to disengage said locking head of said first spring pawl member from said engaging means of said outer tubular shaft, and said locking head being still engaged in said opening of said intermediate tubular shaft when said push button is depressed in the normal position, and on being further pulled downward and depressed into said enlarged opening, said push button will thereby pass through said enlarged opening, said locking head being moved downward to be disenaged from said openings of said intermediate and outer tubular shafts.

4. A fully automatic single push button type umbrella according to claim 1, wherein said outer tubular shaft having a lower ring fixed to the upper end thereof is formed with an engaging means at the lower end portion thereof for engagement with said first spring pawl member and with two openings respectively at the middle and lower portions thereof for engagement with said second spring pawl member.

* * * * *